US006279822B1

(12) United States Patent
Bertram

(10) Patent No.: US 6,279,822 B1
(45) Date of Patent: Aug. 28, 2001

(54) INFORMATION COLLECTION KIOSK

(75) Inventor: James A. Bertram, Adell, WI (US)

(73) Assignee: Bertram Corporation, Random Lake, WI (US)

( * ) Notice: Subject to any disclaimer, the term of this patent is extended or adjusted under 35 U.S.C. 154(b) by 0 days.

(21) Appl. No.: 09/543,523

(22) Filed: Apr. 6, 2000

(51) Int. Cl.[7] ..... G07C 13/02

(52) U.S. Cl. ..... 232/2; 232/44; 232/43.1; 312/211; 312/257.1; 40/611; 248/469; 220/315

(58) Field of Search ..... 232/2, 1 D, 43.1, 232/43.2, 43.5, 44; 312/211, 212, 257.1, 263, 108; 40/606, 566, 567, 611, 572; 248/466, 469, 473; 220/324, 315

(56) References Cited

U.S. PATENT DOCUMENTS

| | | | |
|---|---|---|---|
| 392,856 | * | 11/1888 | Dexter . |
| 824,126 | * | 6/1906 | Little . |
| 1,364,209 | * | 1/1921 | Richardson . |
| 1,424,520 | * | 8/1922 | Richardson et al. . |
| 1,857,552 | * | 5/1932 | Komorous . |
| 1,862,776 | * | 6/1932 | Timberlake . |
| 2,188,419 | | 1/1940 | Saviteer . |
| 3,405,985 | | 10/1968 | Higer . |
| 3,793,756 | * | 2/1974 | Kay et al. . |
| 3,866,824 | | 2/1975 | Lewis . |
| 4,608,773 | * | 9/1986 | White . |
| 4,671,455 | * | 6/1987 | Stockman . |
| 4,699,312 | | 10/1987 | Owen . |
| 4,820,003 | * | 4/1989 | Lloyd . |
| 4,981,259 | | 1/1991 | Ahmann . |
| 5,096,115 | | 3/1992 | Hassan . |
| 5,542,554 | * | 8/1996 | Resnick . |
| 6,012,790 | | 1/2000 | Thomas et al. . |

* cited by examiner

*Primary Examiner*—Lynne H. Browne
*Assistant Examiner*—William L. Miller
(74) *Attorney, Agent, or Firm*—Lathrop & Clark LLP

(57) ABSTRACT

A molded plastic collection bin with transparent front and rear panels receives entry blanks introduced through a slot in a covering counter. The collection bin is supported on two side frames which are formed of tubular aluminum with riveted plastic sheets. Front and rear plastic panels extend between the two side frames and are engaged on protruding fasteners. The counter, the side frames, and the collection bin each have aligned holes which receive two connecting carriage bolts. A bungee cord resiliently extends between the carriage bolts within the collection bin, retaining the assembly in a connected orientation. An information display has a metal frame with retractable threaded tubes which engage with the counter. Printed elements such as posters are clasped between plastic sheets and engaged with C-channels on the frame. A bent metal door selectively covers an access opening in the rear plastic wall of the collection bin. The door has a tab which protrudes through a slot in the bottom wall of the collection bin which receives the bail of a padlock, permitting the door to be secured in a closed position. With the padlock removed, the door may be pivoted out from the bin.

10 Claims, 2 Drawing Sheets

INFORMATION COLLECTION KIOSK

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to furniture and displays in general, and to displays which are speedily assembled and knocked down in particular.

For many products and services it is desirable to market selectively to potential customers having either a special interest or sufficient resources to be a possible purchaser. One technique for obtaining sales leads is to collect information in a targeted geographic area. For example, a provider of Caribbean cruises might solicit addresses of potential customers in northern regions in the winter months. The best and most accurate source of customer name, address, and phone number information is the potential customer. Various promotional activities can be employed to obtain this information voluntarily, for example by providing free samples or offering a free chance to win a prize. Usually the information is solicited by positioning collection boxes or kiosks in the targeted geographic region, for example within shopping malls.

Because a particular marketing venture may require the speedy collection of information, and may be of limited duration, the information collection kiosks are usually temporary structures, and are not built into the shopping mall environment. Furthermore, because of the potential value of the collected consumer information, the completed entry blanks may be a target of theft. Therefore, the collection kiosks must have at least a limited level of security. However, because the cost of collecting the information has a significant labor component, it is desirable to minimize as much as possible the time required to assemble, empty, and disassemble the collection kiosks. Moreover, the kiosks are preferably constructed of low-cost yet sturdy materials.

To promote consumer interest in the collection activity, it is desirable to provide transparent walls to the collection box, thereby allowing a potential contest entrant to make a determination of how popular the contest is. Some collection kiosks have required significant disassembly to collect the completed entry blanks.

What is needed is an information collection kiosk which is economically produced, rapidly assembled and disassembled, and, while easily accessed for removal of entry blanks, provides a level of security against theft.

SUMMARY OF THE INVENTION

The information collection kiosk of this invention has a molded plastic collection bin with transparent front and rear panels for receiving entry blanks introduced through a slot in a covering counter. The collection bin is supported on two side frames which are formed of tubular aluminum with riveted plastic sheets. Front and rear plastic panels extend between the two side frames and are engaged on protruding fasteners. The counter, the side frames, and the collection bin each have aligned holes which receive two connecting carriage bolts. A bungee cord resiliently extends between the carriage bolts within the collection bin, retaining the assembly in a connected orientation. A display assembly has a metal frame with retractable threaded tubes which engage with the counter. Printed elements such as posters are clasped between plastic sheets and engaged with C-channels on the frame. A bent metal door selectively covers an access opening in the rear plastic wall of the collection bin. The door has a tab which protrudes through a slot in the bottom wall of the collection bin which receives the bail of a padlock, permitting the door to be secured in a closed position. With the padlock removed, the door may be pivoted out from the bin.

It is an object of the present invention to provide an information collection kiosk which is assembled in the field without requiring tools.

It is another object of the present invention to provide an information collection kiosk which is rapidly assembled and disassembled.

It is a further object of the present invention to provide an information collection kiosk which may be rapidly emptied.

It is also an object of the present invention to provide an information collection kiosk which may be transported in a compact knocked down condition.

It is yet another object of the present invention to provide an information collection kiosk having a prominent information display region that is easily changed.

It is a still further object of the present invention to provide an information collection kiosk which is rigid and sturdy.

Further objects, features and advantages of the invention will be apparent from the following detailed description when taken in conjunction with the accompanying drawings.

DESCRIPTION OF THE PREFERRED EMBODIMENTS

Figure 1:
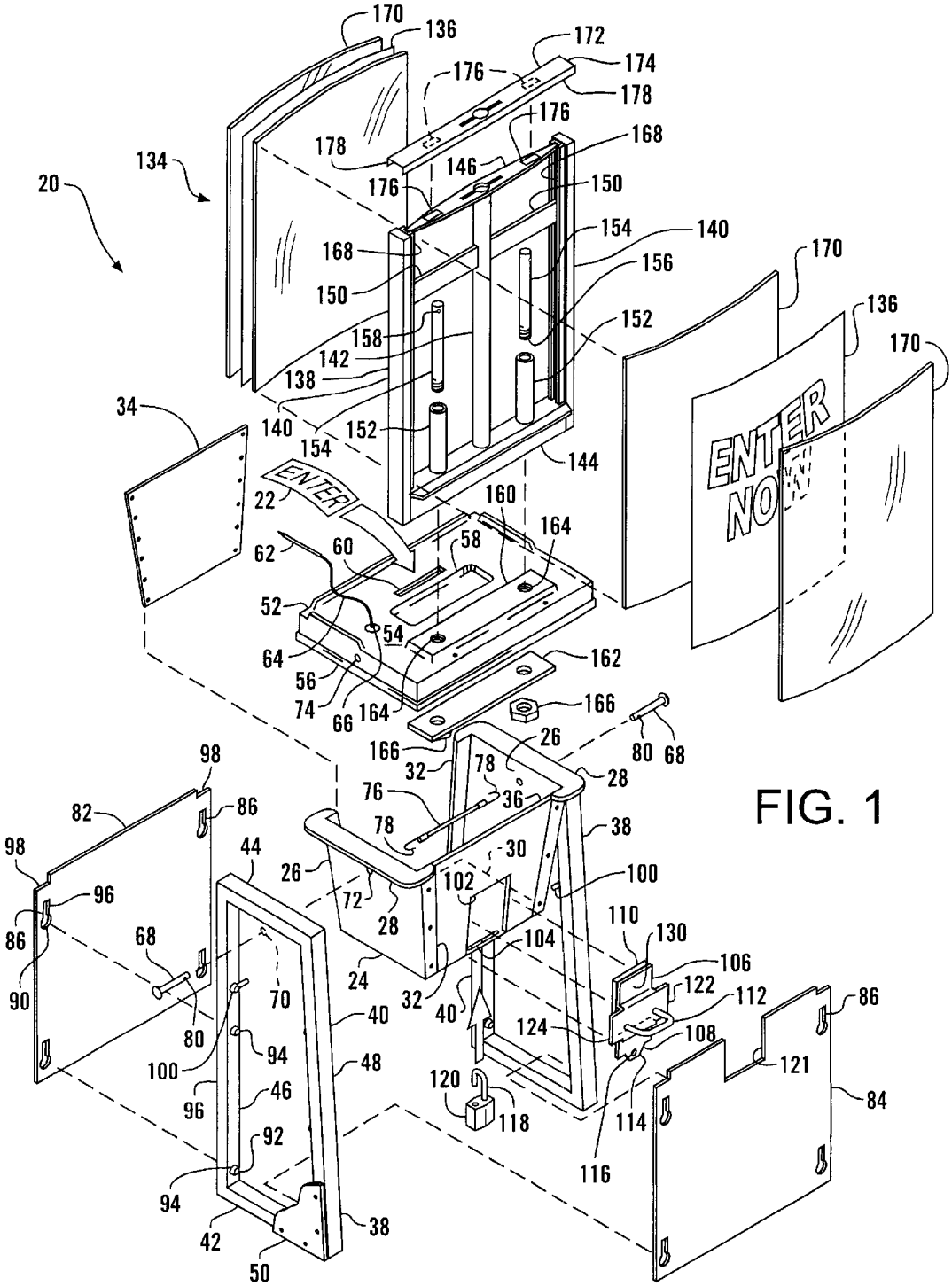
FIG. 1 is an exploded isometric view of the kiosk of this invention.
Figure 3:
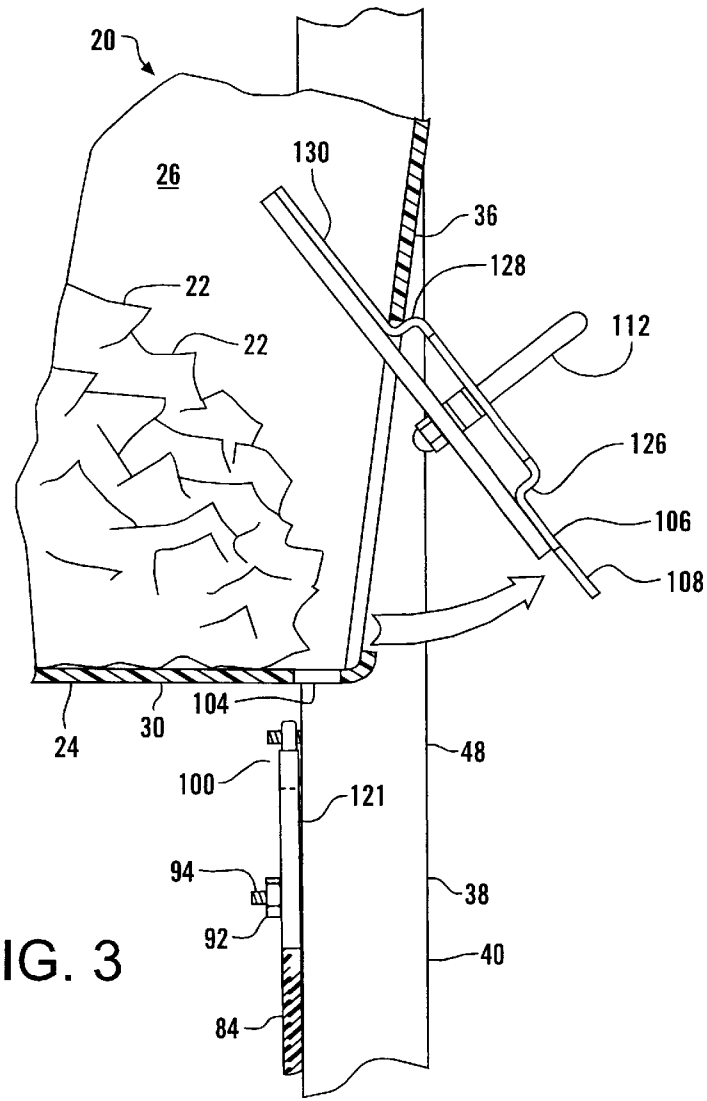
FIG. 3 is a fragmentary cross-sectional view of the kiosk of FIG. 2, showing the access opening to the entry blank collection bin being revealed, with the door shown in side elevational view.
Figure 2:
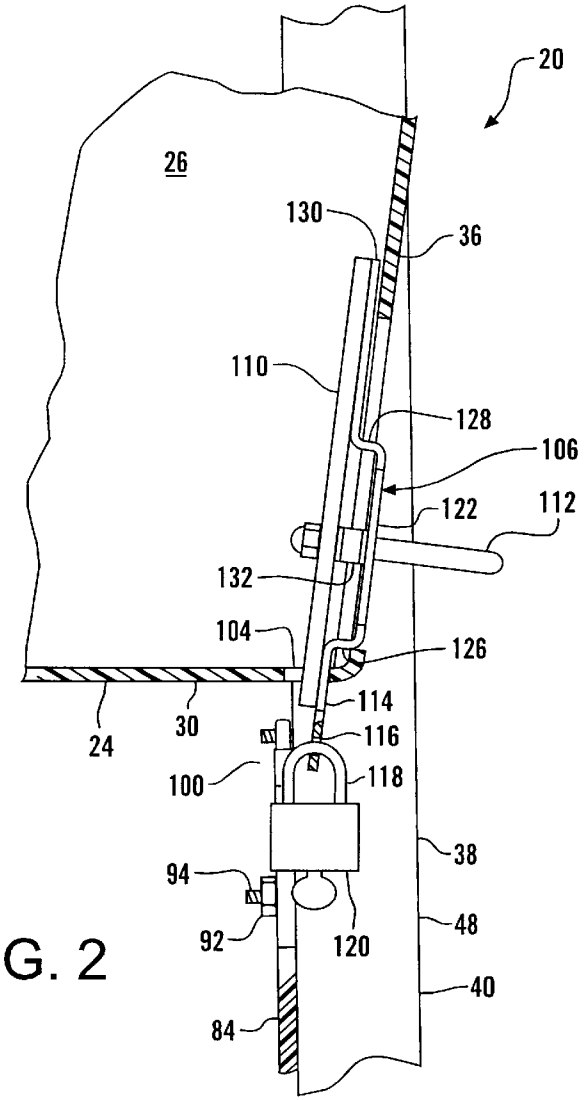
FIG. 2 is a fragmentary cross-sectional view of the kiosk of FIG. 1 showing the access opening to the entry blank compartment being blocked, with the door being only partially broken away in section.

Referring more particularly to FIGS. 1–3, wherein like numbers refer to similar parts, a kiosk 20 for collecting information-containing sheets of paper, such as contest entry blanks 22, is shown in the figures. The kiosk 20 is composed of several subassemblies which are readily connected without the aid of tools.

A collection bin 24 is thermoformed from opaque plastic material and has two spaced upwardly extending and outwardly diverging side walls 26. A side flange 28 extends outwardly from each of the side walls 26. The side walls 26 are joined by a bottom wall 30. front and rear lips 32 extend inwardly from each side wall 26, and transparent plastic panels are riveted to the lips 32 to define the collection bin front wall 34 and rear wall 36. The thermoformed plastic may be ABS plastic, and the transparent plastic may be a polycarbonate material, such as LEXAN manufactured by GE Plastics.

The collection bin 24 is supported in an elevated position by two spaced side frames 38. Each side frame 38 has a tubular side frame member 40 with a base segment 42 and a top segment 44 spaced above and parallel to the base segment, and joined to the base segment by a front segment 46 which converges toward a rear segment 48. A stiff plastic side panel 50 is riveted to each side frame member 40. The side panels may be formed of cut or routed sheets of textured ABS plastic. The side flanges 28 of the collection bin extend over the top segments 44 of the side frame members 40.

A counter 52 is a thermoformed from thermoplastic material such as ABS plastic, and is disposed over the collection bin 24 and the side frames 38. The counter 52 has an upper wall 54 with a downwardly extending peripheral skirt 56 which overlaps portions of the collection bin front wall and rear wall and portions of the side frame top segments 44. The counter upper wall may have a recess 58 molded therein to retain a stack of entry blanks 22. An entry blank slot 60 is routed into the counter upper wall 54. The entry blank slot 60 is sufficiently wide to permit convenient insertion of an entry blank 22, but is sufficiently narrow to prohibit access to the interior of the collection bin 24. One or more writing instruments 62 may be attached to the counter 52, each instrument being connected to the counter 52 by a cable 64 which extends through an opening 66 in the counter upper wall 54.

The side frames 38, the bin 24, and the counter 52 are connected together by two carriage bolts 68 which extend through aligned holes, and which are joined within the interior of the collection bin by a resilient cable 76 with hooks 78 on each end, such as a bungee cord. The side frame bolt holes 70 are formed in the side panels 50 immediately below the top segments 44 of the side frame members 40. The collection bin bolt holes 72 are formed in the bin side walls 26 beneath the side flanges 28. The counter bolt holes 74 are formed in the peripheral skirt 56. Each carriage bolt 68 has a transverse hole 80 which extends into the interior of the collection bin 24. The bungee cord hooks 78 are engaged with the transverse holes 80. The bungee cord 76 is selected of a length sufficiently short to apply tension to the carriage bolts 68 and retain them in position. The hooks 78 of the bungee core 76 prevent the removal of the carriage bolts 68 from the outside.

The stiffness of the structure is greatly increased by a front panel 82 and a rear panel 84 which are connected between the side frames 38. The front panel 82 and rear panel 84 are cut from sheets of plastic material and are each provided with four slots 86 generally at the four corners of the panel. Each slot 86 has a lower generally circular opening 90 which is larger than the protruding head 92 of a bolt 94 which is fastened to a front segment 46 or rear segment 48 of a side frame member 40 and which extends inwardly. As shown in FIG. 3, the bolt head 92 is spaced from the tubular frame segment to which it is connected a distance sufficient to provide clearance for the thickness of the plastic panel. Each slot 86 has a vertical portion 96 extending upwardly from the circular opening 90, the vertical portion being narrower than the bolt head 92. To attach the panels 82, 84 to the side frames 38, the circular openings 90 of the four slots 86 are positioned over the bolt heads 92 and the panel is displaced toward the tubular segment of the frame member from which the bolt heads protrude. The attached panel is then displaced downwardly so that the bolts 94 extend through the narrow vertical portions 96 of the slots 86. To restrict undesired upward displacement of the panels 82, 84, which might result in the panels separating from the bolts 94, the front panel 82 and the rear panel 84 have relieved upper comers 98 into which single wing nuts 100 may be rotated. The relieved comers 98 allow the wing nuts 100 to be rotated to point sidewardly when it is desired to remove the panels 82, 84. When the wing nuts 100 point downwardly, upper displacement of the panels 82, 84 is prevented.

When the counter 52 is secured in place over the collection bin 24 by the carriage bolts 68 and the bungee cord 76, the only outlet of the entry blanks 22 from the collection bin 24 is through an access opening 102 cut in the rear wall 36 of the collection bin. The opening 102 is generally rectangular and is positioned immediately above the bin bottom wall 30. A slot 104 is cut in the collection bin bottom wall 30 at a location spaced inwardly slightly from the access opening 102. As shown in FIGS. 2–3, the access opening 102 to the bin 24 is selectably blocked by a removable door 106.

The door may be fabricated in a variety of fashions, for example as an injection molded part, a stamped part, or a machined part, or, as shown in the drawings, as an assembly of a bent sheet metal element 108 and a plastic sheet 110 with a protruding handle 112. The sheet metal element 108 has a downwardly extending lock tab 114 which, in the locked position shown in FIG. 2, protrudes through the slot 104. The lock tab 114 has a hole 116 positioned below the bottom wall 30 of the bin 24 in the locked position. The hole 116 receives the bail 118 of a conventional padlock 120. The rear panel 84 has a cut-out 121 beneath the access hole, to provide clearance for the padlock 120. The door 106 has a central rectangular section 122 which is wider than the width of the access opening 102. The portions of the door rectangular section 122 which extend on either side of the access opening adjacent the exterior of the bin rear wall 36 define two sidewardly extending side tabs 124 which prevent the inward displacement of the door 106.

The central rectangular section 122 is spaced rearwardly of the lock tab 114 by a spacer flange 126. A second spacer flange 128 is positioned above the spacer flange 126 and extends rearwardly from the top of the central rectangular section 122. An interior tab 130 extends upwardly from the second spacer flange 128 within the bin 24 and extends adjacent to the forward surface of the rear wall 36. The interior tab 130 is approximately the same height as the central rectangular section 122. The access opening 102 has a height which is somewhat less than the combined height of the interior tab 130 and the central rectangular section 122 of the door 106. Therefore, when the lock tab 114 is received within the slot 104, the interior tab 130 and the central rectangular section 122 block access into the collection bin 24. However, as shown in FIG. 3, when the padlock 120 is removed, and the door is slid upwardly so that the lock tab 114 clears the slot 104, the lock tab may be rotated rearwardly to permit the interior tab 130 to be withdrawn from within the bin 24.

As shown in FIG. 2, the door 106 is stiffened by fastening the plastic sheet 110 with double sided adhesive tape at the upper edge and the lower edge to the interior tab and the lock tab respectively. The metal handle 112 extends through the central rectangular section 122 and is fastened to the plastic sheet 110 with screws. The spacing between the plastic sheet 110 and the central rectangular section 122 may be maintained by positioning nuts or washers 132 therebetween.

A display assembly 134 permits printed elements 136 such as posters to be displayed above the counter 52. The display assembly 134 has a display frame 138 with two upwardly extending side members 140 connected to a central column 142 by a lower cross member 144, an upper cross member 146, and two struts 150. The lower cross member 144 is positioned upwardly of the lower limit of the display frame 138. Two outer tubes 152, preferably aluminum, are welded to the lower cross member 144, one on each side of the central column 142. Downwardly opening holes are provided in the lower cross member 144 beneath each outer tube 152. An inner tube 154 is received within each outer tube 152 and is slidable vertically within the outer tube. The inner tubes may be conventional PVC pipes. The lower end of each inner tube 154 has male threads 156 which extend below the lower cross member 144. Once inserted within the outer tube 152, each inner tube is provided with a protrusion 158 such as a screw which prevents the inner tube from dropping out downwardly from the outer tube. Hence, prior to assembly and during storage and transportation, the inner tubes are compactly received within the outer tubes and within the display frame 138.

To assemble the display assembly 134 on the counter 52, the display frame 138 is positioned on the counter 52 above a reinforced ledge 160. A steel reinforcing bar 162 is riveted beneath pipe holes 164 in the counter ledge 160. Female threaded elements such as nuts 166 are welded to the underside of the reinforcing bar 162 and threadedly receive the threads 156 of the inner tubes 154.

Vertically extending metal C-channels 168 open toward one another within the display frame 138. The struts 150 bisect the C-channels. A printed element 136 is clasped between two plastic sheets 170, at least the outer one of which is transparent. The sheets 170 and the surrounded printed element 136 are then engaged within the two opposed C-channels 168, causing the sheets 170 and printed element to take on a curve. A similar assembly of plastic sheets and printed element may be positioned on both sides of the display frame 138. The upper cross member 146 tapers from a wide section at the central column 142 to a narrower section where it joins the C-channels 168. This tapering conforms to the shape of the sheets 170.

A molded plastic cap 172 has an upper wall 174 which overlies the upper cross member 146 and which is connected to the upper cross member by strips 176 of hook and loop fastener material. The cap 172 has downwardly extending side walls 178 which engage the top edges of the plastic sheets 170.

In the field, assembly of the kiosk 20, as shown in FIG. 1, may be accomplished entirely without the aid of tools. First, the two side frames 38 are placed parallel to one another and spaced apart approximately the width of the front and rear panels 82, 84. Each of the panels 82, 84 is then attached to the protruding bolt heads 92 by bringing the slots 86 over the bolt heads and lowering the panels. The panels are retained in place by pivoting the wing nuts 100 downwardly into the shallow relieved upper comers 98. Next, the collection bin 24 is set on the assembled side frames and the counter 52 is set on top of the bin and side frames 38. With the holes 74, 70, 72 aligned in the counter 52, side frames 38, and bin 24 respectively, the two bolts 68 are inserted to extend into the bin. The assembler then takes the bungee cord 76 in one hand and inserts it through the access opening 102 in the rear wall 36, hooking first one hook 78 through an opening 80 in one of the bolts 68, and then hooking the second look 78 through the opening 80 in the other bolt 68. The door 106 is then inserted to block the opening 102 and a padlock 120 affixed to the lock tab 114.

The display assembly 134 is then connected to the counter 52 by positioning the display frame 138 over the reinforced ledge 160. The protruding ledge 160 also helps to properly align the inner tubes 154 with the holes 164 in the ledge. Because the inner tubes are free to slide within the outer tubes 152, the threaded ends 156 will descend into the holes 164, through the reinforcing bar 162 to engage with the threaded elements 166. The upper portions of the inner tubes 154 are then rotated to threadedly engage the inner tubes with the reinforcing bar, and thereby fix the display assembly to the counter 52. The display elements 136 are each placed between two plastic sheets 170, and the three layers are bent so that the sides are engaged within the two opposed C-channels 168. The assembly is completed by pressing the plastic cap 172 down onto the upper cross member 146 to engage the opposed strips 176 of hook and loop fastener. Disassembly will follow a similar procedure in reverse.

The assembled kiosks 20 may be positioned in areas of consumer interest. A consumer who wishes to supply personal information for participation in the promotional event selects an entry blank 22 from the recess 58, completes it with the supplied writing instrument 62 and deposits it through the entry blank slot 60 into the collection bin 24.

From time to time the kiosk 20 is serviced by removal of the entry blanks and by the occasional replacement of the printed display elements 136. For both service activities, no tool is required other than the key for the padlock 120.

It is understood that the invention is not limited to the particular construction and arrangement of parts herein illustrated and described, but embraces such modified forms thereof as come within the scope of the following claims.

I claim:

1. A kiosk for the receipt of entry blanks therein, comprising:

a first upwardly extending side frame, the first side frame having portions defining a bolt hole;

a second upwardly extending side frame spaced sidewardly from the first side frame, the second side frame having portions defining a bolt hole;

a collection bin positioned between the first side frame and the second side frame, the collection bin having two spaced upwardly extending side walls, a front wall, and a rear wall spaced from the front wall, portions of the side walls defining opposed bolt holes;

a counter which overlies and covers the bin, wherein the counter has a downwardly extending flange, portions of the flange defining bolt holes which are aligned with the first side frame bolt hole and the second side frame bolt hole and the bin side wall bolt holes;

a first connector bolt which extends through one of the counter flange bolt holes, the first side frame bolt hole, one of the bin side wall bolt holes, and into the interior of the collection bin;

a second connector bolt which extends through one of the counter flange bolt holes, the second side frame bolt hole, and one of the bin side wall bolt holes, and into the interior of the collection bin;

a resilient cord connector extending between and connected to the first connector bolt and the second connector bolt within the collection bin, the counter, collection bin, first side frame, and second side frame being thereby connected together;

portions of the collection bin rear wall which define an access opening into the collection bin, through which the resilient cord connector is accessible; and a door which is selectably fixed to the collection bin to alternatively block access to the interior of the collection bin, or to permit access to the interior of the collection bin.

2. The kiosk of claim 1 wherein each side frame comprises a tubular side frame member having a front segment joined to a rear segment by a top segment, wherein a side panel is fixed to each side frame member.

3. The kiosk of claim 2 further comprising:

a plurality of fasteners connected to each front segment of each side frame member, the fasteners having portions which protrude rearwardly; and a front panel having portions defining openings corresponding to each of said fasteners, each opening having a lower portion which is larger than the fastener protruding portions, and an upper portion which is narrower than the fastener protruding portions, such that the front panel is connected to the side frame member front segments, and is releasable therefrom by upward and rearward displacement.

4. The kiosk of claim 3 further comprising a wing fastener connected to each front segment, wherein the wing fasteners are pivotable to engage with portions of an upper edge of the front panel, to restrict upward displacement of the front panel.

5. A kiosk for the receipt of elements therein, comprising:

a frame;

a collection bin supported on the frame, the collection bin having a bottom wall, and a front wall which extends upwardly from the bottom wall, and a rear wall spaced from the front wall which extends upwardly from the bottom wall;

a counter which overlies and covers the bin;

portions of the collection bin rear wall which define an access opening into the collection bin; and a door, which in a first position is fixed to the collection bin to block access to the interior of the collection bin, and in a second position is removed from the collection bin to permit access to the interior of the collection bin, wherein the collection bin bottom wall has portions defining a slot positioned below the access opening, and wherein the door has a downwardly extending lock tab which extends through the slot in the first position, the lock tab having portions defining a hole, such that a bail of a lock is receivable through the lock tab hole, to prevent the withdrawing of the lock tab from the slot in the first position, and wherein two side tabs are spaced rearwardly from the lock tab, the two side tabs extending in the first position sidewardly beyond the access opening to overlie the collection bin rear wall, and wherein an interior tab extends upwardly from the door above the side tabs, and spaced rearwardly from the side tabs, such that in the first position the interior tab extends upwardly within the collection bin frontwardly of the collection bin rear wall, such that in the first position, the door blocks access to the interior of the bin, and on removal of the bail of the lock from the lock tab, the door is freely removable from the bin.

6. The kiosk of claim 5 wherein the door is comprised of a bent sheet metal element defining the lock tab and the interior tab and a stiffening sheet of plastic which extends between and is fastened to the lock tab and the interior tab.

7. The kiosk of claim 5 wherein the two side tabs of the door are portions of a central rectangular section having a first height, and the interior tab extends upwardly from the central rectangular section a second height, and wherein the height of the access opening is less than the combined first height and second height.

8. A kiosk comprising:

a frame;

a collection bin supported on the frame a counter which overlies and covers the bin, the counter having a top wall having portions defining two upwardly facing pipe openings;

a reinforcement bar having threaded openings positioned beneath the counter top wall, and fixed thereto; and a display assembly releasably connected to the counter, the display assembly having an upwardly extending display frame with two sidewardly spaced side members, and a lower cross member which extends between the side members, and wherein two outer tubes extend upwardly from the lower cross member, and wherein an inner tube is received within each of the outer tubes, each inner tube having a lower threaded end, the lower threaded ends of the inner tubes being extendable through the counter pipe openings, to be threadedly engaged with the reinforcement bar threaded openings, and wherein the inner tubes are in a first extended position when engaged with the reinforcement bar, and in a second retracted position when withdrawn into the outer tubes, the display assembly having vertically extending graphic elements connected between the side members.

9. The kiosk of claim 8 wherein a C-channel is connected to each of the two side members, the two C-channels facing towards one another, and wherein a central column extends upwardly from the lower cross member between the two side members, and wherein the graphic elements are clasped between two bendable sheets of plastic, the assembly of the two sheets of plastic and the graphic element being engaged between the opposed C-channels.

10. The kiosk of claim 8 further comprising:

an upper cross member spaced above the lower cross member and connected between the two side members; and a cap positioned over the upper cross member and releasably connected thereto, the cap having downwardly extending side walls which retain upper edges of the graphic elements.

* * * * *